US005520951A

United States Patent [19]

Yasuhara

[11] Patent Number: 5,520,951

[45] Date of Patent: May 28, 1996

[54] METHOD FOR APPLYING SEALANT TO A TONER CONTAINER FOR AN IMAGE FORMING APPARATUS

[75] Inventor: Masateru Yasuhara, Kawasaki, Japan

[73] Assignee: Canon Kabushiki Kaisha, Tokyo, Japan

[21] Appl. No.: 187,726

[22] Filed: Jan. 28, 1994

[30] Foreign Application Priority Data

Feb. 1, 1993 [JP] Japan ..... 5-014836

[51] Int. Cl.[6] ..... B05D 1/12

[52] U.S. Cl. ..... 427/8; 427/256; 427/284; 427/424; 427/425

[58] Field of Search ..... 427/8, 256, 424, 427/425, 284; 355/260; 118/409, 410

[56] References Cited

U.S. PATENT DOCUMENTS 4,458,628 7/1984 Fujii et al. ..... 118/409

5,208,634 5/1993 Ikemoto et al. ..... 355/215

*Primary Examiner*—Shrive Beck
*Assistant Examiner*—David M. Maiorana
*Attorney, Agent, or Firm*—Fitzpatrick, Cella, Harper & Scinto

[57] ABSTRACT

In a sealant applying apparatus, a three-axis orthogonal type robot is installed at any location, and the three-axis orthogonal type robot is provided with an X axis arm, a Y axis arm and a Z axis arm. The Z axis arm has fixed thereto a reversing unit inclinable about the axis thereof. A workpiece is fixed to the reversing unit, and the surface of the workpiece to which a sealant is to be applied can be made substantially horizontal by the driving of the reversing unit. A sealant discharging apparatus is provided in such a manner that a discharge nozzle is positioned above the workpiece, and the sealant discharging apparatus is fixed by a support arm.

1 Claim, 9 Drawing Sheets

FIG. 5

FORMAT FOR COMMAND POSITION DATA STORE

AREA1

| POINTER ADDRESS | X-AXIS DATA | Y-AXIS DATA | Z-AXIS DATA |
|---|---|---|---|
| 0 | 0 | 0 | 0 |
| 1 | 10 | 5 | -2 |
| 2 | 20 | 10 | -4 |
| ⋮ | ⋮ | ⋮ | ⋮ |
| n | 100 | 50 | -20 |

AREA2

| POINTER ADDRESS | X-AXIS DATA | Y-AXIS DATA | Z-AXIS DATA |
|---|---|---|---|
| 0 | 0 | 0 | 0 |
| 1 | 5 | 15 | -3 |
| 2 | 10 | 30 | -6 |
| ⋮ | ⋮ | ⋮ | ⋮ |
| n | 50 | 150 | -30 |

FIG. 7

TARGET POSITION TABLE

| LAPSING TIME t | X-AXIS DATA | Y-AXIS DATA | Z-AXIS DATA |
|---|---|---|---|
| 0 | 0 | 0 | 0 |
| 1 | 1 | 2 | 3 |
| 2 | 2 | 4 | 6 |
| 3 | 3 | 6 | 9 |
| n | 100 | 200 | 300 |

METHOD FOR APPLYING SEALANT TO A TONER CONTAINER FOR AN IMAGE FORMING APPARATUS

BACKGROUND OF THE INVENTION

1. Field of the Invention

This invention relates to a sealant applying apparatus and a sealant applying method for applying, when assembling a toner container removably mountable on an image forming apparatus such as an electrophotographic copying apparatus or an LBP (laser beam printer), a sealant to the joined surface of members forming the toner container, and a toner container for an image forming apparatus obtained by the use of the sealant applying method.

2. Related Background Art

In image forming apparatuses such as electrophotographic copying apparatuses and LBPs (laser beam printers), there is known a cartridge directed to the facilitation of the replacement of process portions due to the termination of their service life, and the stabilization and improvement of the quality of printing, by including the process portions necessary for image formation integrally in a frame member, and making this frame member interchangeable.

FIG. 9 of the accompanying drawings is a cross-sectional view showing an example of the cartridge according to the prior art, and FIG. 10 of the accompanying drawings is a cross-sectional view showing the cartridge of FIG. 9 as it is separated into an upper frame member and a lower frame member.

The cartridge 1 shown in FIG. 9 is a toner container (hereinafter referred to as a "toner cartridge") removably mountable with respect to an image forming apparatus, and in a cartridge frame member 1*a*, there are disposed a photosensitive drum 2 as an image bearing member, and a cleaning device 3, a developing device 4 and a charger 5 as process portions disposed around the photosensitive drum.

The cleaning device 3 is comprised of a cleaning blade 3*a* for removing waste toner (waste developer) from the photosensitive drum 2, a scraping sheet 3*b* for preventing the removed waste toner from leaking outwardly, and a waste toner containing portion 3*c* for storing the waste toner therein.

The developing device 4 is comprised of a developing sleeve 4*a* rotatable in a predetermined direction to supply toner (developer) retained on the outer peripheral portion thereof to the photosensitive drum 2, a regulating blade 4*b* for regulating the layer thickness of the toner on the developing sleeve 4*a*, and a toner containing portion 4*c* for storing the toner therein and supplying it to the developing sleeve 4*a*.

The toner containing portion 4*c* and the waste toner containing portion 3*c* are formed in the cartridge 1 by an upper frame member A and a lower frame member B being coupled together by pawls 50 and screws 51, as shown in FIG. 10. The toner containing portion 4*c* is formed by the upper frame member A and the lower frame member B being coupled together, and a blade holder 30*a* holding the regulating blade 4*b* and the upper frame member A being coupled together, and prevents the leakage of the toner from the coupled portions by a seal member 14*b* being provided on the coupled portion of the upper frame member A and the lower frame member B and a seal member 14*a* being provided on the coupled portion of the blade holder 30*a* holding the regulating blade 4*b* and the upper frame member A. Also, the waste toner containing portion 3*c* is formed by the upper frame member A and the lower frame member B being coupled together, and a blade holder 30*b* holding the cleaning blade 3*a* and the upper frame member A being coupled together, and prevents the leakage of the toner from the coupled portions by a seal member 13*b* being provided on the coupled portion of the upper frame member A and the lower frame member B and a seal member 13*a* being provided on the coupled portion of the blade holder 30*b* holding the cleaning blade 3*a* and the upper frame member A.

As the seal members 13*a*, 13*b*, 14*a* and 14*b* in the toner cartridge as described above, use has been made of a flexible urethane foam sticked on the coupled surface of one of the upper and lower frame members by means of a both-side tape. However, if such seal members are adopted, it will be difficult to detach the flexible urethane foam and the both-side tape when the toner cartridge is to be disassembled and cleaned, and an inconvenience will arise in the process of sensing the toner cartridge. Therefore, an attempt is conceived to apply a sealant composed of foamed urethane to the joined surface and solidify it, instead of using the sealing members provided by the flexible urethane foam and the both-side tape.

On the other hand, the sealant applying apparatus according to the prior art for applying a sealant onto the coupled surface of one of the upper and lower frame members forming the cartridge is designed such that the upper frame member or the lower frame member of the cartridge as a workpiece is fixed by fixing means with the joined surface which is a surface to which the sealant is to be applied turned upwardly and a discharge nozzle for discharging the sealant by a predetermined amount is moved by a robot along the surface to which the sealant is to be applied, to thereby apply the sealant thereto. Also, a controller for controlling the movement of the nozzle has sequentially controlled the movement of the nozzle to a given target position [X, Y, Z] on real time while finding the data of a command position by a control function comprising PX=f(X, t), PY=f(Y, t) and PZ=f(Z, t) at each servo period (e.g. 5 ms) controlled by a timer.

However, the above-described prior-art sealant applying apparatus, which is designed such that the work is fixed and the nozzle for discharging the sealant by a predetermined amount is moved by the robot along the surface to which the sealant is to be applied, to thereby apply the sealant, has suffered from the following problems:

(1) When the weight of the apparatus for discharging the sealant is as great as about 30 kg, the carrying weight of the robot is also required to be of the same degree. Therefore, a large robot is required.

(2) By the discharge nozzle being moved, the liquid surface of the sealant in the discharge nozzle is vibrated. Therefore, the liquid surface is not stable and the amount of discharge is varied.

(3) When the discharge nozzle is moved to apply the sealant to a curved portion, the discharged liquid is greatly deflected outwardly by the influence of a centrifugal force and a desired locus cannot be described.

Also, the controller for moving the nozzle sequentially moves the nozzle on the basis of a given target position while finding a command position by a predetermined control function at each certain servo period, and this has led to the following problems:

(4) To stabilize the movement velocity of the nozzle to the target position, it is necessary to rapidly produce each command position data on the locus. This requires the controller to have a rapid calculating process capability.

(5) The controller is designed to output command positions in succession when the calculating process by the predetermined control function at each certain period is completed and therefore, if the calculating process time fluctuates, the output interval between the command positions will fluctuate. Therefore, the movement velocity of the nozzle is not stable and the amount of application becomes unstable. For example, when the sealant is applied to a series of surfaces comprising straight portions and curved portions to which the sealant is to be applied, the calculation time becomes long for the curved portions and therefore, the output interval between the command positions becomes long and the movement velocity of the nozzle is reduced. Thus, the amount of application to the curved portions becomes great and the locus becomes thick.

FIG. 11 of the accompanying drawings shows the manner in which the sealant is applied to the coupled surface of the upper frame member A shown in FIG. 10.

In the prior-art sealant applying apparatus, when a nozzle 52 is moved along a complicated application course 53 as shown in FIG. 11, the sealant sometimes deviates from the application course on the joined surfaces which are curved portions, due to the problems noted above, and when the sealant deviates from the surfaces 102*a* and 102*b* of the upper frame member A to which the sealant is to be applied, the prevention of the toner leakage by the seal member formed by the solidification of the sealant becomes insufficient when the upper frame member is coupled to the lower frame member B (see FIG. 10). Also, the thickness of the seal member is usually made greater than a predetermined gap after the coupling of the upper and flower frame members, and is set such that the sealant is crushed to fill up the predetermined gap completely, but if the amount of sealant applied to the joined surface which is the surface to which the sealant is to be applied becomes partly irregular, the thickness of the seal member formed on this joined surface by the solidification of the sealant will also become irregular and there will be created portions thinner than the predetermined gap after the coupling of the upper and lower frame members and thus, the toner may sometimes leak.

SUMMARY OF THE INVENTION

The present invention has been made in view of the above-noted problems peculiar to the prior art, and the object thereof is to provide a sealant applying apparatus and a sealant applying method capable of applying a sealant by a predetermined amount of application along a desired locus when the sealant is to be applied to the joined surface of members forming a toner container for an image forming apparatus, and a toner container for an image forming apparatus.

A first invention for achieving the above object is a sealant applying apparatus provided with a discharge nozzle for applying a sealant to a surface to which the sealant is to be applied and which forms a continuous complicated course comprising at least the curved portions and inclined portions of a member forming a toner container for an image forming apparatus, characterized in that said discharge nozzle is fixed, and said apparatus has:

a holding bed for holding said member provided in opposed relationship with the direction of the tip end of said discharge nozzle;

driving means for driving said holding bed in three-dimensional directions; and a controller for controlling said driving means so that said member may move along the course of said surface to which the sealant is to be applied.

Said sealant applying apparatus is further provided with reversing means for inclining said holding bed with said member, and is characterized in that said controller controls the amount of inclination by said reversing means with the control of said driving means in conformity with the course of said surface to which the sealant is to be applied, and when said holding bed is driven, said holding bed is inclined by said reversing means in conformity with the amount of inclination of the inclined portion of said surface to which the sealant is to be applied so that the surface of said member to which the sealant is to be applied may become substantially horizontal.

In said apparatus, said controller may be one which produces command position data in advance on off-line and stores said data in a memory unit, and controls the movement of said driving means while taking out said command position data when said holding bed is driven, or one which rapidly calculates the locus course of the surface of said member to which the sealant is to be applied and controls the movement of said driving means by the use of the result of said calculation, and foamed polyurethane rubber is used as said sealant.

A second invention may be a sealant applying method of applying a sealant to a surface to which the sealant is to be applied and which forms a continuous complicated course comprising at least the curved portions and inclined portions of a member forming a toner container for an image forming apparatus, characterized by the steps of:

holding said members on reversing means having the reversing function;

disposing the predetermined position of the surface of said member to which the sealant is to be applied in opposed relationship with a sealant discharging nozzle fixed at a predetermined location; and moving said member from the predetermined position of said surface to which the sealant is to be applied along the course of said surface to which the sealant is to be applied, and applying the sealant thereto;

and characterized in that when said member is moved along the course of said surface to which the sealant is to be applied and the sealant is applied thereto, the posture of said member is inclined by said reversing means in conformity with the amount of inclination of the inclined portions of said surface to which the sealant is to be applied.

In this case, the data of the amount of inclination for inclining said member by said reversing means and applying position data for moving and controlling said member along the course of said surface to which the sealant is to be applied are stored in advance in a memory unit, and said data are taken out to thereby move and control said member when the sealant is applied.

Again in the above-described method, foamed polyurethane rubber is used as said sealant.

A third invention is a toner container for an image forming apparatus which is formed by at least a first member having a first joint surface forming a continuous complicated course comprising at least curved portions and inclined portions, and a second member having a second joint surface joined to said first joint surface, characterized in that said first member and said second member are combined together through a seal member formed by the solidification of a sealant after the sealant is applied to one of said first joint surface and said second joint surface by the use of the above-described sealant applying method.

Said toner container may preferably have a restraining member for combining said first member and said second member together, and that portion of one of said first joint surface and said second joint surface which is near said restraining member may preferably be a sealant application starting point.

In the present invention constructed as described above, the predetermined position of the surface of the members to which the sealant is to be applied is disposed in opposed relationship with the fixed discharge nozzle, and the members are moved along the course of the surface thereof to which the sealant is to be applied by the driving means while the sealant is discharged from the discharge nozzle to the surface to which the sealant is to be applied. Thereby, vibration or the like is not transmitted to the discharge nozzle because the discharge nozzle is fixed, and the amount of discharge becomes stable.

Also, in the control of the members by the driving means, the controller produces and stores in advance the command position data of the application course on off-line, and controls the movement of the members during the movement driving of the members while taking out said command position data. Thereby, the calculating process speed for outputting the command position data is not limited and therefore, the movement velocity of the members becomes stable and the amount of application to the surface of the members to which the sealant is to be applied becomes stable.

Further, when the surface of the members to which the sealant is to be applied is inclined, the members are inclined with the holding bed by the reversing means and the surface of the members to which the sealant is to be applied during discharge is made substantially horizontal, whereby the quality of the application is improved.

BRIEF DESCRIPTION OF THE DRAWINGS

FIG. 5 shows examples of data stored.

FIG. 7 shows the target position table of the three-axis orthogonal type robot provided in an embodiment of the present invention.

DETAILED DESCRIPTION OF THE PREFERRED EMBODIMENTS

Some embodiments of the present invention will hereinafter be described with reference to the drawings.

Figure 1:
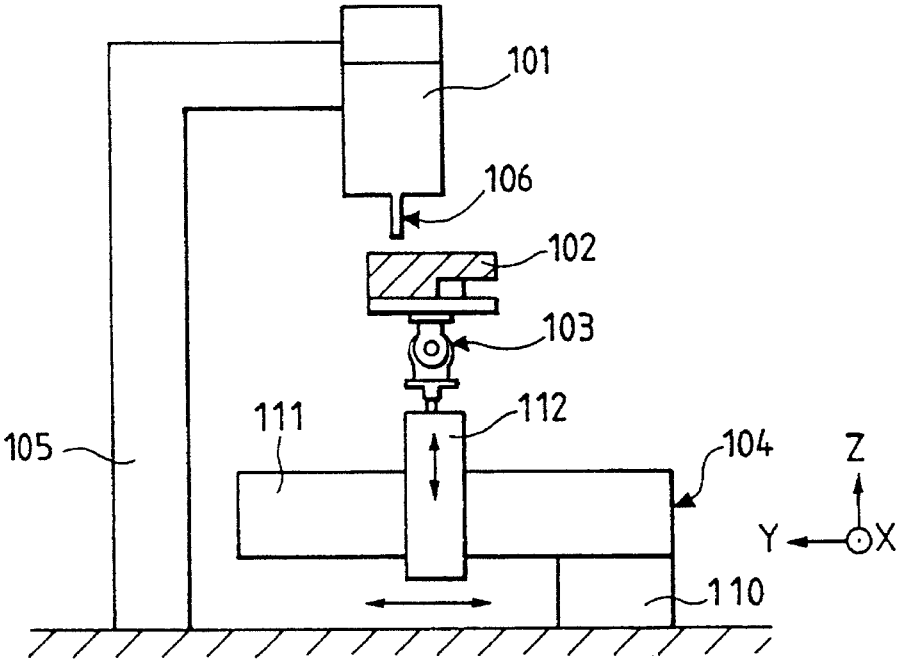
FIG. 1 is a front view schematically showing the construction of an embodiment of the sealant applying apparatus of the present invention.
Figure 2:
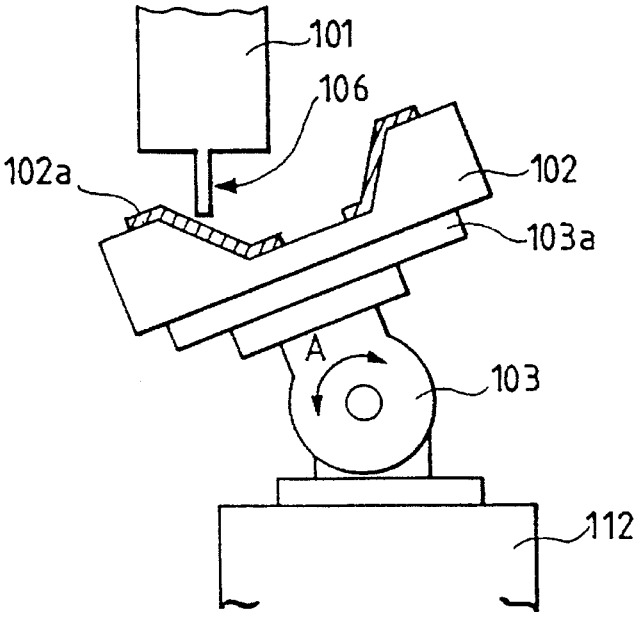
FIG. 2 is an enlarged view of the essential portions of FIG. 1.

FIG. 1 is a front view schematically showing the construction of an embodiment of the sealant applying apparatus of the present invention, and FIG. 2 is an enlarged view of the essential portions of FIG. 1.

The sealant applying apparatus of the present embodiment, as shown in FIGS. 1 and 2, is provided with a three-axis orthogonal type robot 104 as driving means installed at any location. This three-axis orthogonal type robot 104 is provided with an X axis arm 110 fixed on the installment surface and extending in the direction of X axis, a Y axis arm 111 supported on the X axis arm 110 for movement in the direction of X axis and reciprocally movable in the direction of X axis by X axis driving means, not shown, and extending in Y direction, and a Z axis arm 112 supported on the Y axis arm 111 for movement in the direction of Y axis and reciprocally movable in the direction of Y axis by Y axis driving means, not shown, and extending in the direction of Z axis.

The Z axis arm 112 has fixed thereto a reversing unit 103 as reversing means supported on the Z axis arm 112 for movement in the direction of Z axis and reciprocally movable in the direction of Z axis by Z axis driving means, not shown. The reversing unit 103, as shown in FIG. 2, is driven in directions A about the axis thereof by driving means, not shown, such as a motor. Further, the reversing unit 103 has fixed thereto a workpiece holding bed **103*a* for holding a workpiece 102, and the workpiece holding bed 103*a* can be inclined by the driving of the reversing unit 103, which can hold the surface 102*a* of the workpiece 102** to which a sealant is to be applied substantially horizontally.

The discharge nozzle 106 of a sealant discharging apparatus 101 for discharging a sealant is provided above and in opposed relationship with the workpiece 102, and the sealant discharging apparatus 101 is fixed by a support arm 105.

The sealant applying apparatus of the present embodiment is provided with a controller (not shown) such as an I/O controller, which controls the sealant discharging apparatus 101, the reversing unit 103 and the three-axis orthogonal type robot 104 in accordance with the substance of a pre-stored program.

Description will now be made of a case where the sealant is applied to the joint surface of the upper frame member A as a workpiece shown in FIG. 11, by the use of the sealant applying apparatus of the above-described construction.

Description will first be made of a control system for controlling the three-axis orthogonal type robot so that the workpiece may move along the course of the surface thereof to which the sealant is to be applied.

Figure 3:
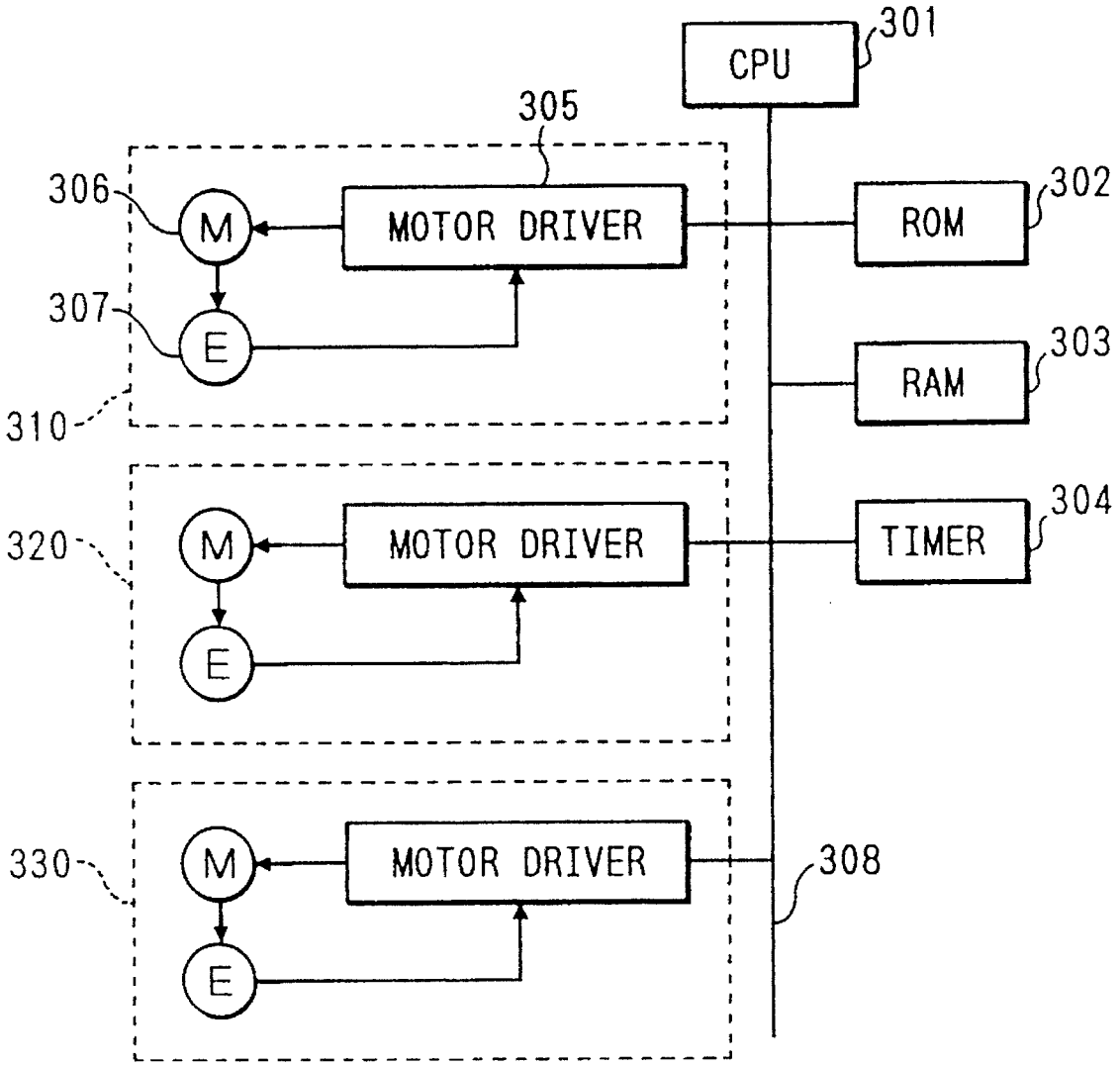
FIG. 3 is a block diagram showing a control system for controlling a three-axis orthogonal type robot in an embodiment of the present invention.

FIG. 3 is a block diagram showing the control system for controlling the three-axis orthogonal type robot provided in an embodiment of the present invention.

In FIG. 3, the reference numeral 301 designates a CPU which is a controller for effecting the analysis and calculation of commands, the reference numeral 302 denotes a ROM having stored therein the commands to be executed by the CPU, the reference numeral 303 designates a RAM which is a memory unit for storing data therein, the reference numeral 304 denotes a timer for measuring time, the reference numeral 308 designates a bus for giving and taking data, the reference numeral 305 denotes a motor driver for driving a motor, the reference numeral 306 designates a motor for moving the robot, and the reference numeral 307 denotes an encoder for detecting the position of the motor. An X axis unit 310 is comprised of the motor driver 305, the motor 306 and the encoder 307, and a Y axis unit 320 and a Z axis unit 330 are constructed similarly thereto.

The CPU 301 successively interprets and executes the commands stored in the ROM 302 to thereby control the respective axis units 310, 320 and 330 are operate the robot.

Figure 11:
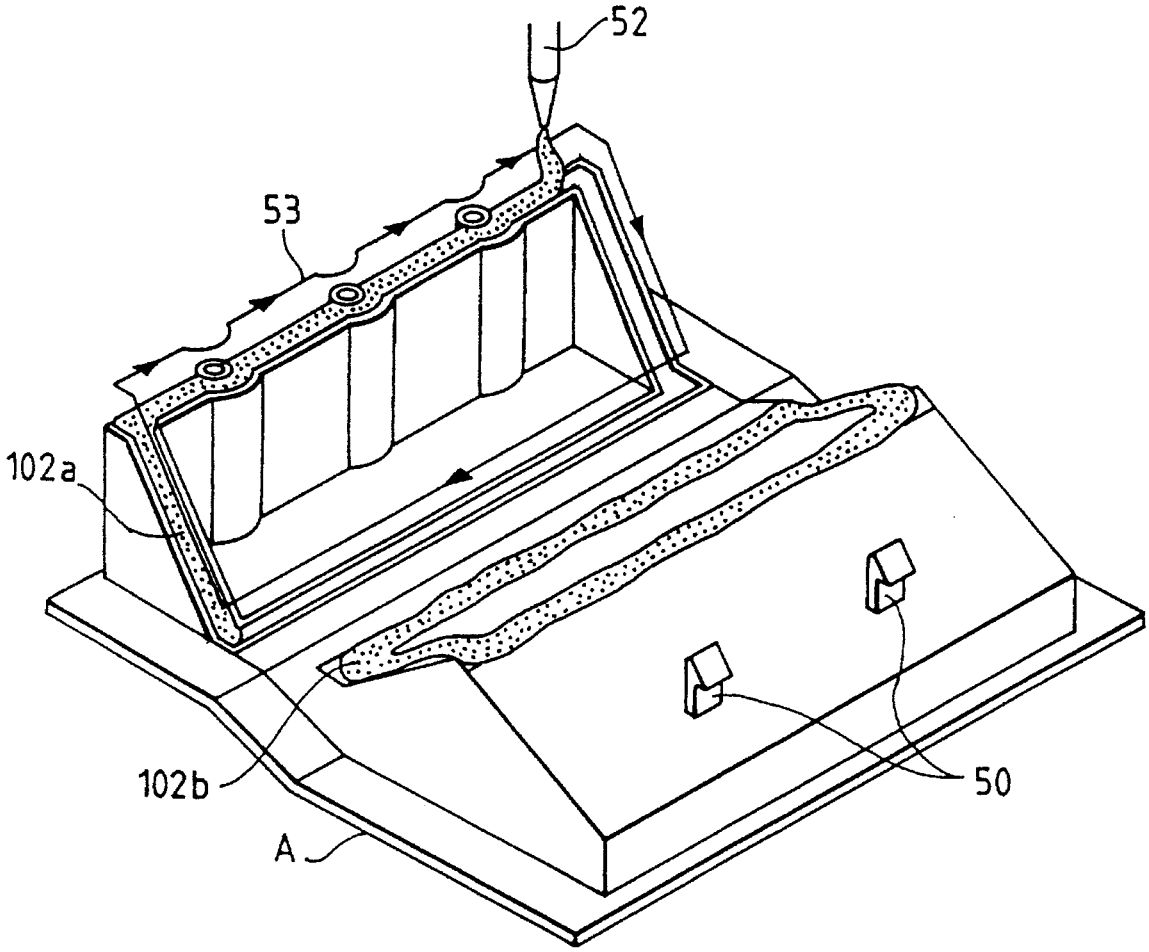
FIG. 11 PRIOR ART
FIG. 11 shows the manner in which a sealant is applied to the coupled surface of the upper frame member A shown in FIG. 10.

In the present embodiment, the CPU 301 produces, on the basis of the command in the ROM 302, command position data along the application course of the upper frame member A shown in FIG. 11, on off-line, and stores the data into the RAM 303, and controls the driving of the three-axis orthogonal type robot while taking out the command position data during the operation.

The production of the command position data can be accomplished by a method described, for example, in Japanese Laid-Open Patent Application No. 1-41908. Here, description will be made of the commands stored in the ROM 302 as to how the command position data produced by the above-mentioned method are stored in the memory unit on off-line, and how the data are taken out during the operation to thereby effect the control of movement.

Figure 4:
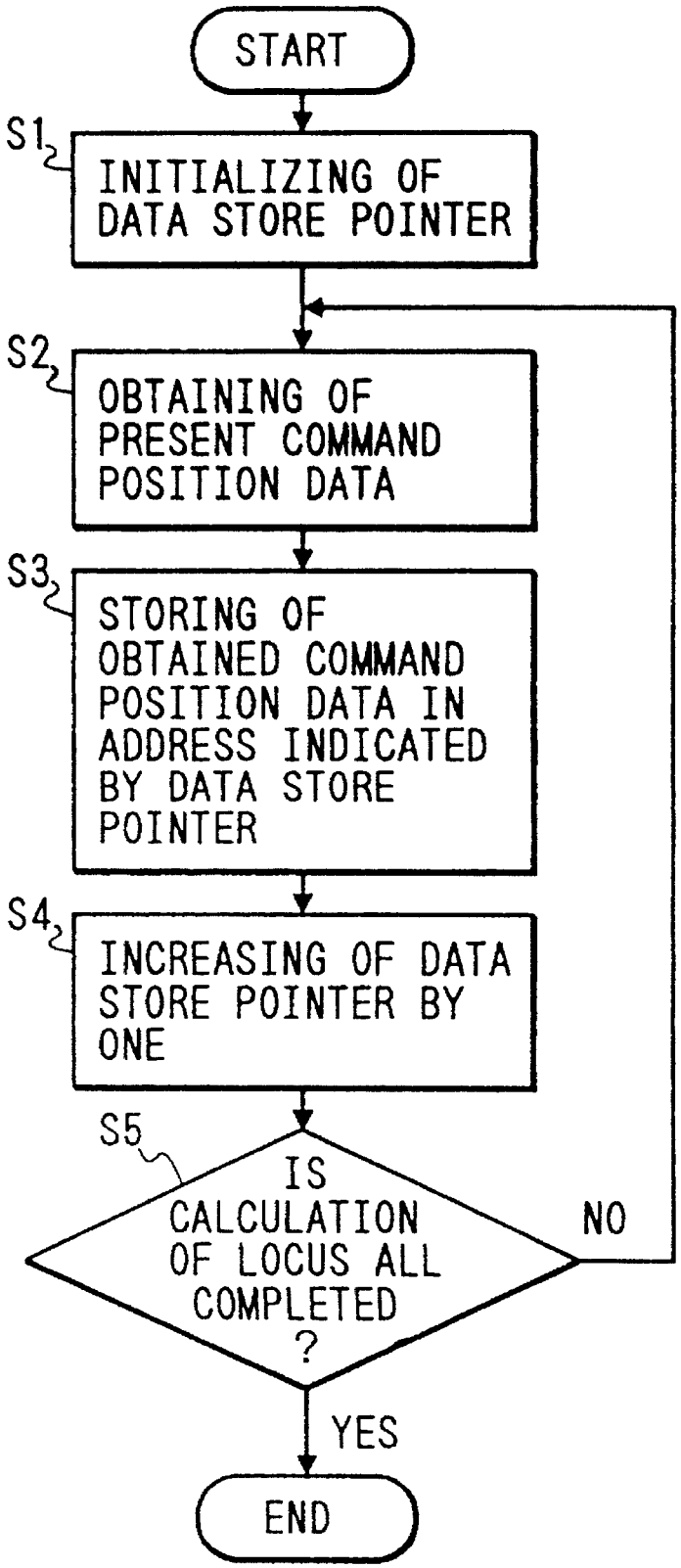
FIG. 4 is a flow chart showing the storing operation for a command position on off-line.

FIG. 4 is a flow chart showing the storing operation for the command position on off-line. As shown in this figure, the initializing of data store pointer is first effected (step S1). Subsequently, the present command position data is calculated (step S2). The command position data obtained at the step S2 is stored into an address indicted by the data store pointer (step S3). Examples of the data stored are shown in FIG. 5.

For the next data storing, the data store pointer is then increased by one (step S4). Subsequently, whether a series of calculations of locus have all been completed is judged (step S5). If it is judged that the calculations of locus have not all been completed, return is made to the step S2 and the above-described operations are repeated. If it is judged that the calculations of locus have all been completed, the command position storing operation on off-line is terminated.

Figure 6:
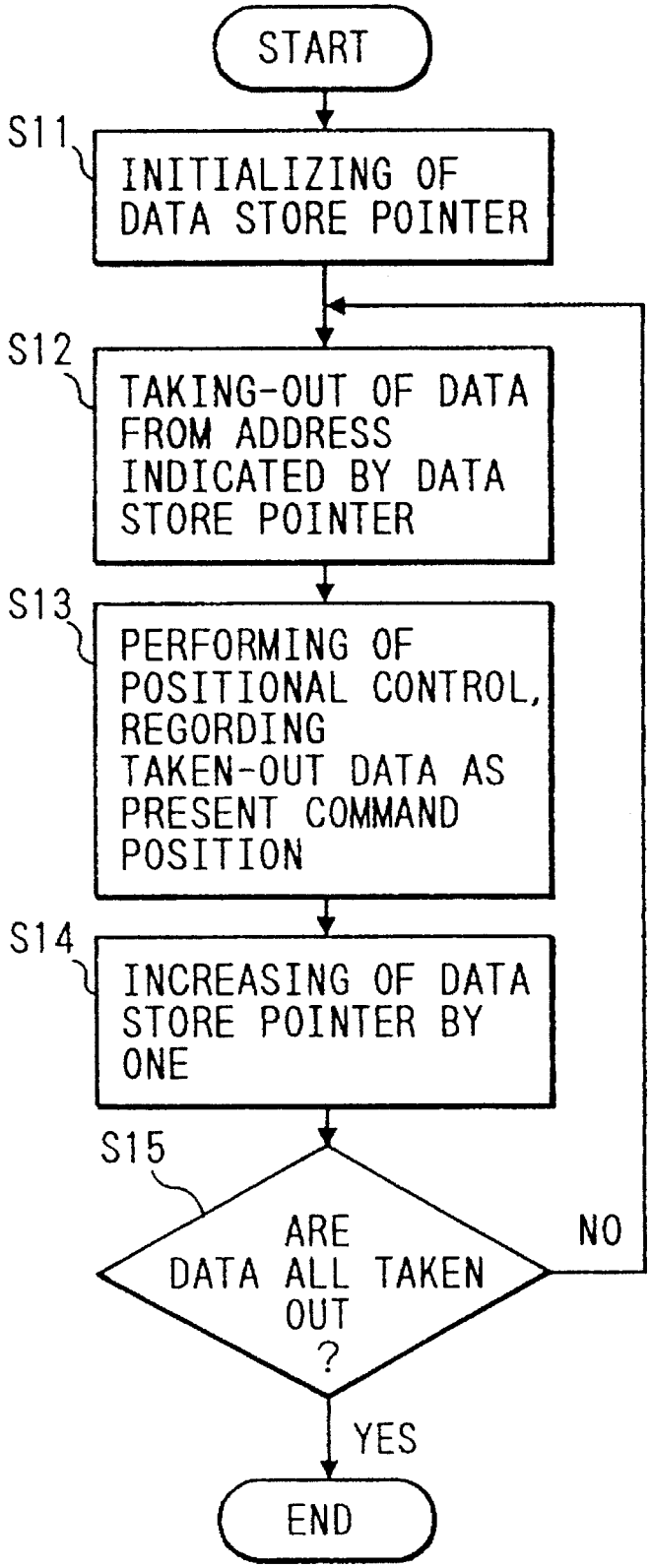
FIG. 6 is a flow chart showing the data taking-out operation during driving.

The data taking-out operation during driving will now be described with reference to FIG. 6. FIG. 6 is a flow chart showing the data taking-out operation during driving.

The initializing of data store pointer is first effected (step S11). Subsequently, the command position data calculated and stored in advance is taken out from an address indicated by the data store pointer (step S12). Subsequently, position control is effected with the taken-out data as the present command position data (step S13). The data store pointer is then increased by one so as to indicate the next data (step S14). Whether a series of data of locus stored have all been taken out is then judged (step S15). If it is judged that the data of locus have not all been taken out, return is made to the step S12 and the above-described operations are repeated. If it is judged that the data of locus have all been taken out, the data taking-out operation during driving is terminated.

In the present embodiment, in order to apply the sealant to two continuous surfaces as shown in FIG. 11 to which the sealant is to be applied by operating the reversing unit, the two data store areas are prepared and changed over. For this purpose, access can be made to the data store pointer by two-dimensional arrangement like area number and pointer number. If such a method is adopted, it will become possible to select a plurality of loci and operate them.

Description will be more specifically made of the movement control of the three-axis orthogonal type robot based on the command stored in the ROM 302. FIG. 7 shows the target position table of the three-axis orthogonal type robot provided in an embodiment of the present invention.

Assuming that the present position coordinates [X, Y, Z] (pulse) of the three-axis orthogonal type robot are e.g. [0, 0, 0] and the target position coordinates thereof are [100, 200, 300], the CPU 301 calculates necessary command position data by functions PX=f(100, t), PY=f(200, t) and PZ=f(300, t) at every predetermined period set by the timer 304. The obtained command position data are evolved as data for each axis arm with the time t as an argument from the movement starting time of the three-axis orthogonal type robot, on the table as shown in FIG. 7. The calculation is effected until the command position become the same as the target position while t is sequentially varied, and the command position data of the movement locus to the target position are all evolved on the table and stored in the RAM 303.

Describing the X axis unit 310 in the operation based on the command position data evolved on the table, the CPU 301 reads out the command position data being evolved in the RAM 303 at each predetermined period indicated by the timer 304, and sets the data in the motor driver 305. The motor driver 305 drives the motor 306 in accordance with the set command position data, and the X axis arm 110 of the three-axis orthogonal type robot 104 is driven by the motor 306. Likewise, the Y axis arm 111 of the three-axis orthogonal type robot 104 and the Z axis arm 112 of the three-axis orthogonal type robot 104 are driven by the Y axis unit 320 and the Z axis unit 330, respectively. When the reading-out of the data up to the end of the command position data being evolved in the RAM 303 is terminated (t=n), the operation of the three-axis orthogonal type robot 104 is stopped.

The controller in the present embodiment calculates the command position data in advance on off-line and stores the data, and drives the driving means during the operation while taking out the command position data, whereas the present invention is not restricted thereto, but the controller may be one using a high-speed CPU which does not delay the driving time, and driving the driving means while calculating on on-line.

Also, the amount of inclination of the reversing unit 103 (see FIGS. 1 and 2) as the reversing means provided in the sealant applying apparatus of the present invention is controlled by the following procedure.

The controller (not shown) pre-stores point data (position coordinates) indicative of the shape of the workpiece input by the user of the apparatus in the RAM, calculates the amount of inclination of the surface of the workpiece to which the sealant is to be applied, from the point delta (position coordinates) of the present value and the target value when the workpiece is driven to move, and controls the reversing unit 103 when the workpiece is driven to move, so that the surface of the workpiece to which the sealant is to be applied may become substantially horizontal in conformity with said amount of inclination.

Where the workpiece 102 shown in FIGS. 1 and 2 is the upper frame member A shown in FIG. 11, the operation of applying the sealant to the joint surface of the upper frame member A by the sealant applying apparatus of the present embodiment will now be described with reference to FIGS. 1, 2 and 11.

The user of the apparatus holds the upper frame member A shown in FIG. 11 on the workpiece holding bed 103*a* with the joint surface which is the surface to which the sealant is to be applied turned upwardly. Thereafter, the user operates the apparatus.

The controller moves the upper frame member A with the aid of the three-axis orthogonal type robot 104 to thereby position the application starting point (A) of the upper frame member A below the discharge nozzle 106 of the sealant discharging apparatus 101. It then calculates the amount of inclination of the surface to which the sealant is to be applied, from the point data (position coordinates) of the present value and the target value, and controls the reversing unit 103 so that the surface of the workpiece to which the sealant is to be applied may become substantially horizontal in conformity with said amount of inclination. That is, in the upper frame member A of FIG. 11 as the workpiece, the first application course is inclined from the application starting point (A) and therefore, the reversing unit 103 is driven on the basis of the amount of inclination of this inclined portion, and is positioned at such an angle that the surface 102*a* of the upper frame member A to which the sealant is to be applied becomes generally horizontal.

The upper frame member A is then moved by the three-axis orthogonal type robot 104 on the basis of the pre-stored command position data and at the same time, the discharge of a predetermined amount of sealant is started by the sealant discharging apparatus 101. The course of discharge onto the surface 102A to which the sealant is to be applied begins with (A) and progresses as indicated by arrows and overlaps at the original point (A), thereby forming a course of closed loop. Thus, the sealant discharged by the sealant discharging apparatus 101 is applied onto the surface 102*a* of the workpiece 102 to which the sealant is to be applied.

Figure 10:
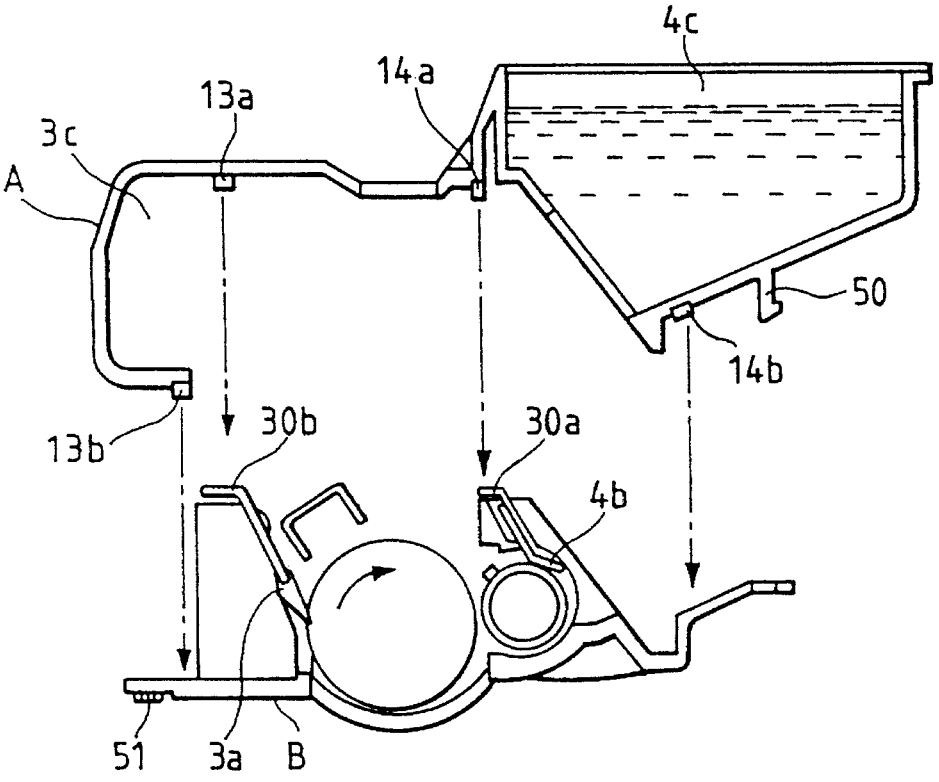
FIG. 10 PRIOR ART
FIG. 10 is a cross-sectional view showing the cartridge of FIG. 9 as it is separated into an upper frame member and a lower frame member.

On the other hand, the sealant is also applied to the surface 102*b* of the upper frame member A to which the sealant is to be applied with the reversing unit 103 and the three-axis orthogonal type robot 104 controlled by an operation similar to that described above (see FIG. 1). The application course on this surface 102*b* to which the sealant is to be applied begins with an application starting point (B) which is the vicinity of the two pawls 50, preferably the middle portion between the two pawls 50 which are the opening-closing restraining portions of the toner container and progresses therefrom and overlaps at the original point (B), thereby forming a course of closed loop. The reason why the application starting point is thus provided near the pawls 50 is that even if the sealant solidifies in the overlapping portion (B), whereby the thickness of the seal member swells more or less, when the upper frame member A is combined with the lower frame member B (see FIG. 10), the swell of the seal member will be sufficiently urged by the engagement of the pawls 50 and any gap which may be created by the swell will be eliminated.

Now, in the present embodiment, it has been shown that by the sealant discharging apparatus 101, the sealant is discharged to the joint surface of the upper frame member A shown in FIG. 11, and this sealant is obtained .by mixing two-liquid type reacting liquids. So, reference is now had to FIG. 8 to specifically describe the system of the sealant discharging apparatus 101 which discharges the sealant from the discharge nozzle 106.

Figure 8:
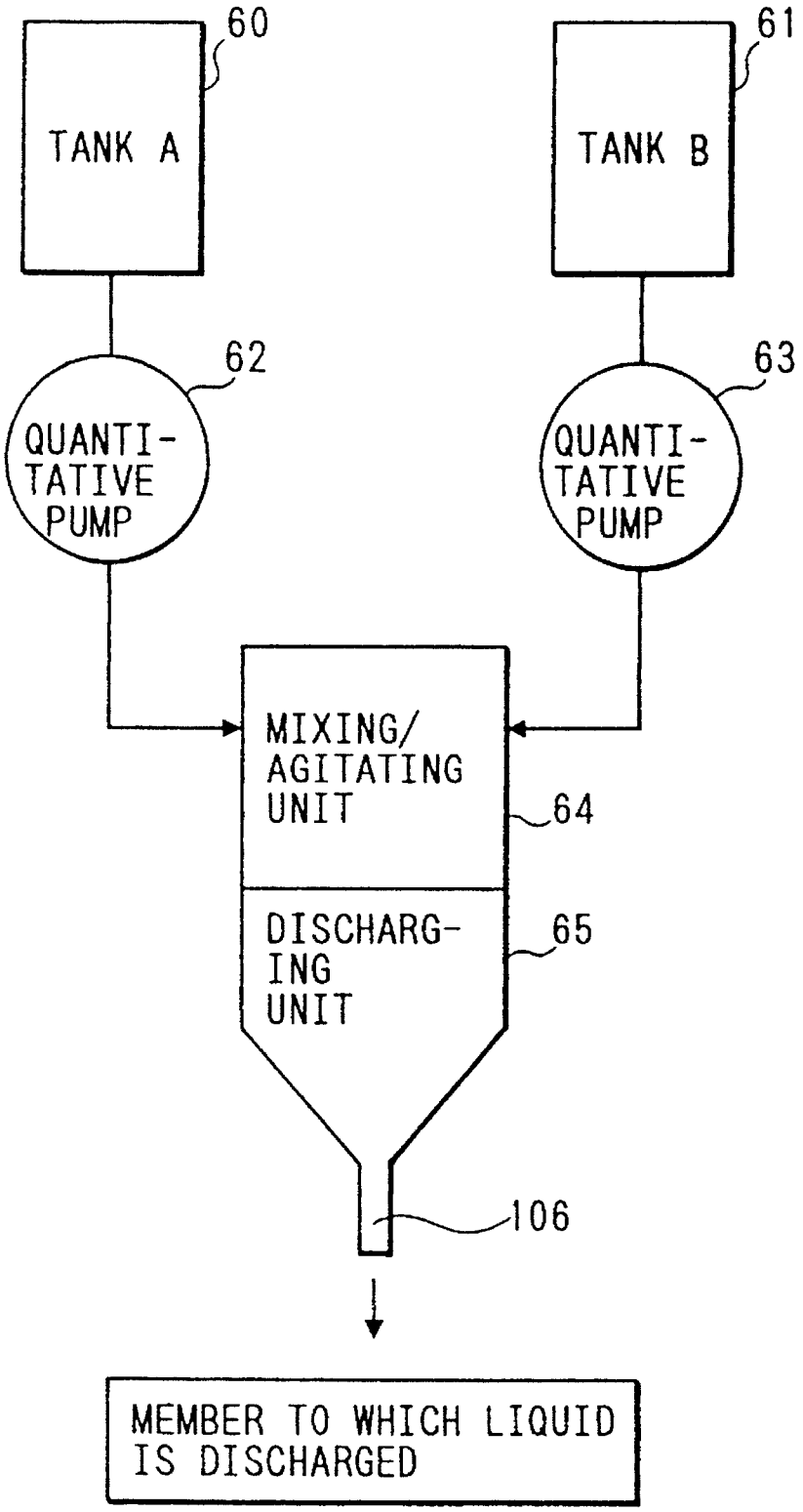
FIG. 8 is a schematic diagram for illustrating the discharge system of a sealant discharging apparatus.
Figure 9:
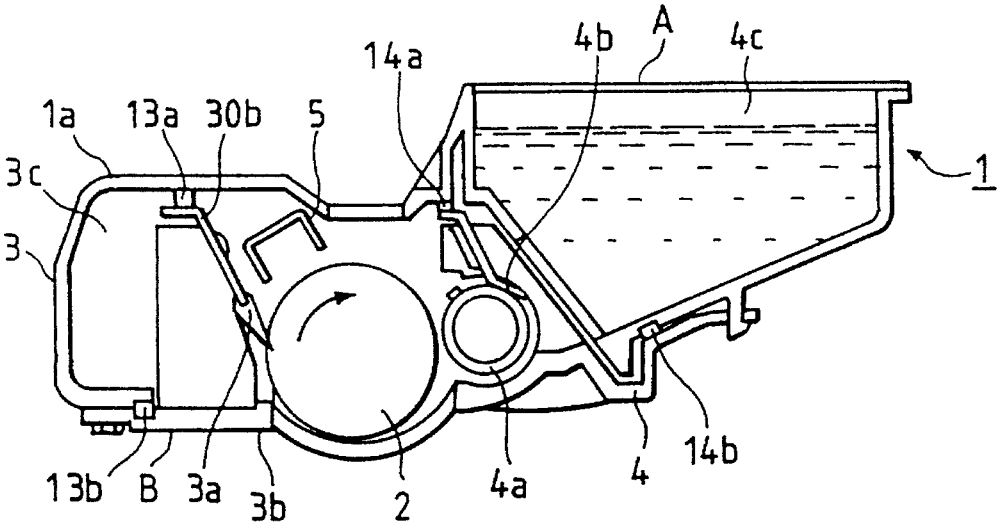
FIG. 9 PRIOR ART
FIG. 9 is a cross-sectional view showing an example of the cartridge according to the prior art.

FIG. 8 is a schematic diagram for illustrating the discharge system of the sealant discharging apparatus 101.

In FIG. 8, liquid A and liquid B are supplied from tanks A60 and B61 containing therein liquid A and liquid B, respectively, to a mixing/agitating unit 64 by precision quantitative pumps 62 and 63 so as to assume a mixing ratio optimum for the reaction of two liquids. In the mixing/agitating unit 64, forced agitation by a motor is effected so that liquid A and liquid B may uniformly mix. It takes at least 30 seconds for these two liquids to react and solidify and thereby become elastomer having elasticity and therefore, at the intermediate stage of the reaction, the liquids are discharged as liquid elastomer from the discharge nozzle 106 of a discharging unit 65. The measurement of the two-liquid mixing ratio of liquid A and liquid B by the quantitative pumps 62 and 63 and the mixing/agitating speed are controlled to optimum conditions in accordance with a substance programmed in advance in a controller (not shown) such as an I/O controller. In the present embodiment, the solidified elastic elastomer (seal member) is foamed polyurethane, and polyole and isocyanate are used as liquid A and liquid B, respectively, and the mixing ratio of liquid A and liquid B is 10:2–3 and the foaming magnification thereof is 2 to 5 times. However, the present invention is not restricted thereto, but the seal member may be foamed silicone.

As described above, in the present embodiment, the discharge nozzle is fixed and the member is movement-controlled along the course of the surface to which the sealant is to be applied while the sealant is discharged from the discharge nozzle and while the position data of the locus course calculated and stored in advance are successively taken out and therefore, it becomes possible to apply the sealant stably as per the desired application course.

Thus, when the sealant is to be applied to the complicated application course as shown in FIG. 11, the sealant does not deviate from the application course on the joint surface which is a curved portion as in the prior art, and when the frame members forming the toner container are coupled together, the leakage of toner can be prevented by the seal member formed by the solidification of the sealant. Also, the amount of application to the surface to which the sealant is to be applied becomes generally uniform and therefore, the thickness of the seal member formed by the solidification of the sealant also becomes uniform, and there is no possibility of a portion which is thinner than the predetermined gap after the coupling of the upper and lower frame members forming the toner container being created to permit the leakage of toner. Thus, there can be provided a toner container free of the possibility of toner leakage.

As described above, in the present embodiment, the discharge nozzle of the sealant discharging apparatus is fixed and the member to which the sealant is to be applied is made movable, whereby the downsizing of the robot can be achieved and the liquid surface of the sealant in the sealant discharging apparatus is kept constant and therefore, stable discharge can be realized and the quality of application is improved.

Also, in the movement control of the members by the driving means, the command position data are produced in advance on off-line and stored, and during the operation, control is effected while the command position data are taken out and therefore, even if the processing ability of the controller is a low speed, the movement velocity of the nozzle relative to the surface to which the sealant is to be applied will become stable and thus, application of high quality can be accomplished.

Further, the present embodiment is of a construction in which the member to which the sealant is to be applied can be inclined at a certain angle with respect to the axis of rotation thereof and therefore, it becomes possible to keep the surface to which the sealant is to be applied generally horizontal, and the quality of application is improved.

What is claimed is:

1. A method of applying a sealant to a joint portion of a member for forming a toner container for an image forming apparatus, wherein the joint portion includes a sealant application straight section having a predetermined length in a linear direction of an X-axis relative to a reference plane consisting of an X-axis, a Y-axis and a Z-axis, and a sealant application inclined section having an inclined angle relative to the Y-axis and the Z-axis, said method comprising the steps of:

holding the member with a parallel movement means for movement in the X-axis and the Y-axis in parallel on a reversing means for controlling a position of the sealant application inclined section to be disposed in horizontal posture relative to the reference plane;

storing position data and inclined angle data of each said sealant application section in a memory unit;

disposing sealant applying means in a sealant application starting position of the joint portion of the member held on the reversing means; and applying the sealant in a linear direction while moving the member in parallel by the parallel movement means and applying the sealant to the sealant application inclined section while moving the member in parallel and while holding the sealant application inclined section in a horizontal posture by said reversing means, in accordance with said position data in the memory unit.

* * * * *

UNITED STATES PATENT AND TRADEMARK OFFICE

CERTIFICATE OF CORRECTION

PATENT NO. : 5,520,951

DATED : May 28, 1996

INVENTOR(S) : MASATERU YASUHARA

It is certified that error appears in the above-indentified patent and that said Letters Patent is hereby corrected as shown below:

Drawings:

SHEET 5 OF 9

FIG. 6

Block S13, "REGORDING" should read --REGARDING--.

COLUMN 2

Line 14, "sticked" should read --stuck--.

COLUMN 7

Line 13, "are operate" should read --and operate--.

COLUMN 8

Line 20, "become" should read --becomes--.

Signed and Sealed this

Fourteenth Day of January, 1997

Bruce Lehman

*Attest:*

BRUCE LEHMAN

*Attesting Officer*

*Commissioner of Patents and Trademarks*